US005308738A

United States Patent [19]

De Keyzer et al.

[11] Patent Number: 5,308,738

[45] Date of Patent: May 3, 1994

[54] SILVER SALT DIFFUSING TRANSFER MATERIAL WITH LIGHT INSENSITIVE SILVER SALT LAYER

[75] Inventors: René M. De Keyzer, Waasmunster; Johan J. Lamotte, Louvain, both of Belgium

[73] Assignee: Agfa-Gevaert, N.V., Mortsel, Belgium

[21] Appl. No.: 894,451

[22] Filed: Jun. 5, 1992

[30] Foreign Application Priority Data

Jun. 20, 1991 [EP] European Pat. Off. ..... 91201577.3

[51] Int. Cl.[5] ..... G03C 5/54

[52] U.S. Cl. ..... 430/230; 430/246; 430/509

[58] Field of Search ..... 430/230, 229, 246, 509, 430/414, 416, 227, 204

[56] References Cited

U.S. PATENT DOCUMENTS

| | | | |
|---|---|---|---|
| 3,765,889 | 10/1973 | Young | 430/230 |
| 4,247,617 | 1/1981 | Debruyn et al. | 430/228 |
| 4,299,908 | 11/1981 | Ito et al. | 430/234 |
| 4,677,052 | 6/1987 | Inoue | 430/230 |
| 4,693,955 | 9/1987 | Torizuka et al. | 430/230 |
| 4,728,596 | 3/1988 | Takaki et al. | 430/230 |
| 4,772,535 | 9/1988 | Yamano et al. | 430/230 |
| 5,068,165 | 11/1991 | Coppens et al. | 430/204 |

OTHER PUBLICATIONS

*Patent Abstracts of Japan*, 59/231530, Ono et al., Dec. 1984.

*Primary Examiner*—Richard L. Schilling
*Attorney, Agent, or Firm*—Breiner & Breiner

[57] ABSTRACT

The present invention provides a photographic material comprising on a support an image-receiving layer containing physical development nuclei, a photosensitive silver halide emulsion layer and a substantially light insensitive layer containing silver salt characterized in that said photosensitive silver halide emulsion layer contains silver halide particles having an average diameter of at least 0.6 μm, said photosensitive silver halide emulsion layer being located between said image-receiving layer and said substantially light insensitive layer and said substantially light insensitive layer having a speed of at least a factor 10 less than said photosensitive silver halide emulsion layer. The present invention also provides a method for making an image therewith. The photographic material of the present invention is of high speed and can yield direct positive image with a low density in the non-image areas.

6 Claims, No Drawings

SILVER SALT DIFFUSING TRANSFER MATERIAL WITH LIGHT INSENSITIVE SILVER SALT LAYER

1. Field of the invention

The present invention relates to a mono-sheet silver salt diffusion transfer material and method for producing direct-positive images therewith.

2. Background of the invention

In silver halide photography a photographic method, according to which a positive image is made without the use of a negative image or an intermediary process producing a negative image, is called a direct-positive method and a photographic light-sensitive element is called a direct-positive element.

Two main types for producing direct-positive image are known. According to a first class use is made of a photographic element containing a direct positive silver halide emulsion. Such types of photographic elements are disclosed in for example U.S. Pat. No. 3,364,026, U.S. Pat. No. 3,501,305, U.S. Pat. No. 2,456,953 and U.S. Pat. No. 3,761,276. These types of photographic material are of rather low speed.

According to the second class use is made of the silver salt diffusion transfer method. The principles of the silver complex diffusion transfer reversal process, hereinafter called DTR-process, have been described e.g. in U.S. Pat. No. 2,352,014 and the book "Photographic Silver Halide Diffusion Processes" by André Rott and Edith Weyde - The Focal Press - London and New York, (1972).

According to the DTR process, a silver complex salt is image-wise transferred by diffusion from the image-wise exposed silver halide emulsion layer into the image receiving layer, where it is converted to a silver image usually in the presence of physical development nuclei. For this purpose, the image-wise exposed silver halide emulsion layer is developed in the presence of a developing agent and non-developed silver halide is converted by means of a silver halide complexing agent into a soluble silver complex salt while in contact with an image receiving layer.

At the exposed areas of the silver halide emulsion layer the silver halide is developed (chemical development) and thus cannot be dissolved any more to diffuse to the receiving layer.

At the unexposed areas of the silver halide emulsion layer the silver halide is converted to a soluble silver complex salt and is transferred to the receiving layer, where it forms a silver image usually in the presence of physical development nuclei.

The DTR process includes (a) a so-called "two-sheet" type where the silver halide emulsion layer and the image receiving layer are contained on separate supports and are brought in contact with each other at the time of diffusion transfer development to produce the silver image in the receiving sheet and (b) a so-called "mono-sheet" type where both the emulsion layer and the layer containing the physical development nuclei are contained on the same support.

According to the DTR process a direct positive image can thus be obtained either with a "mono-sheet" or "two-sheet" type. Mono-sheet type DTR-materials are well known for producing lithographic printing plates. However for producing images this type of DTR-material is less suited because of a rather large density in the non-image areas. A DTR-material of the two-sheet type can yield direct positive image having a large gradation and low density in the non-image areas but is inconvenient for applications as e.g. Computer Output to Microfilm (COM) applications.

3. Summary of the invention

It is an object of the present invention to provide a mono-sheet DTR-material having a density not more than 0.4 in the non-image areas so that it is suitable for use in e.g. COM-applications.

According to the present invention a photographic material is provided comprising on a support an image-receiving layer containing physical development nuclei, a photosensitive silver halide emulsion layer containing silver halide particles having an average diameter of at least 0.6 μm and a substantially light insensitive layer containing silver salt having a speed of at least a factor 10 less than said photosensitive silver halide emulsion layer whereby said photosensitive silver halide emulsion layer is located between said image-receiving layer and said substantially light insensitive layer.

According to the present invention there is also provided a method for obtaining direct-positive images with the above defined photographic material.

4. Detailed description of the invention

It has been found that information-wise exposure and subsequent development of a photographic material comprising on a support an image-receiving layer containing physical development nuclei, a photosensitive silver halide emulsion layer containing silver halide particles having an average diameter of at least 0.6 μm and a substantially light insensitive layer containing silver salt having a speed of at least a factor 10 less than said photosensitive silver halide emulsion layer whereby said photosensitive silver halide emulsion layer is located between said image-receiving layer and said substantially light insensitive layer yields densities in the non-image areas of not more than 0.4 which is acceptable for COM-applications. More preferably the average diameter of the silver halide particles contained in the photosensitive layer is at least 0.8 μm and most preferably at least 1 μm.

By the diameter of a silver halide grain is meant the diameter of a hypothetical sphere with an equivalent volume as the corresponding silver halide grain. The average diameter of the silver halide grains thus being the average of all these diameters. The average diameter can be measured according to e.g. the method described by G. Möler disclosed on the International Congres of Photographic Science (ICPS) held in Moskou from Jul. 29th to Aug. 5, 1970.

It is further important that the speed of the substantially light insensitive layer is at least a factor 10 less than the photosensitive layer in order to take advantage of the present invention. If the speed of the substantially light insensitive layer is not at least a factor 10 less than the photosensitive layer a latent image will be formed in said substantially light insensitive layer which will result in a lower contrast image and an increase of the density in the non-image areas.

According to a preferred embodiment of the present invention the image-receiving layer is the remotest from the support of the three layers described above. However the image-receiving layer may also be closest to the support the substantially light insensitive layer then being the remotest from the support.

Preferred silver salts contained in the substantially light insensitive layer for use in accordance with the present invention are preferably water insoluble silver salts e.g. a silver halide, bromate, molybdate, oxalate, chromate, iodate, isocyanate, thioisocyanate, cyanide, citrate phosphate, silver oxide etc. Said water insoluble silver salts may be prepared using the precipitation reaction of the water soluble salt of the desired anion of the insoluble silver salt with a water soluble silver salt, e.g. silver nitrate, in the presence of a hydrophillic binder.

Preferably the silver salt particles contained in the substantially light insensitive layer are readily transferable to the image-receiving layer during the DTR-process. For this purpose silver salts containing at least 70 mol % of chloride are preferred in the present invention. The silver salt particles are preferably not chemically and/or not spectrally sensitized. It is furthermore advantageous that the particle size of the silver salt is small i.e. an average diameter of less than 0.3 μm is preferred. The silver salt is preferably also doped with $Rh^{3+}$, $Ir^{4+}$, $Cd^{2+}$, $Zn^{2+}$ or $Pb^{2+}$ to reduce the light sensitivity of the silver halide. The silver salt particles may further be desensitized on the surface with a desensitizing agent well known to those skilled in the art. Examples of desensitizing agent are disclosed in e.g. the U.S. Pat. Nos. 2,930,644, 3,431,111, 3,492,123, 3,501,310, 3,501,311, 3,574,629, 3,579,345, 3,598,595, 3,592,653, 4,820,625, 3,933,498, and GB 1.192.384. Further desensitizing agents suitable for use in accordance with the present invention are described e.g. by P. Glafkides in "Chimie et Physique Photographique", Paul Montel, Paris (1967).

The photosensitive silver halide emulsions can be prepared from soluble silver salts and soluble halides according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966).

The photosensitive silver halide emulsions used according to the present invention can be prepared by mixing the halide and silver solutions in partially or fully controlled conditions of temperature, concentrations, sequence of addition, and rates of addition. The silver halide can be precipitated according to the single-jet method or the double-jet method.

The photosensitive silver halide particles of the photographic material used according to the present invention may have a regular crystalline form such as a cubic or octahedral form or they may have a transition form. They may also have an irregular crystalline form such as a spherical form or a tabular form or may otherwise have a composite crystal form comprising a mixture of said regular and irregular crystalline forms.

The photosensitive silver halide particles are preferably of high speed and readily transferable during the DTR-process. It is furthermore advantageous that the photosensitive silver halide particles show a rapid chemical development i.e. silver halide emulsions that show a complete chemical development within at least 15s. The rate of chemical development can be easily determined with the following method. The silver halide emulsion layer of which the rate of chemical development is to be measured is coated to a transparent support in an amount equivalent to 2 g $AgNO_3/m^2$ and 2.1 g gelatin/$m^2$. The thus obtained element is exposed to a suitable light-source and subsequently placed in a cuvette in a spectrophotometer and thermostated at 25° C. A developing solution is brought in the cuvette and the absorption at 800 nm is followed with time. From the plot of the absorption at 800 nm against time the time necessary to obtain a complete development of the sample can be determined.

According to the present invention the photosensitive silver halide emulsion preferably consist principally of silver chloride while a fraction of silver bromide is present ranging from 1 mole % to 40 mole %. The emulsions may be of the core/shell type well known to those skilled in the art in the sense that substantially all the bromide is concentrated in the core. This core contains preferably 10 to 40% of the total silver halide precipitated, while the shell consists preferably of 60 to 90% of the total silver halide precipitated.

In order to reduce the density in the non-image areas it is advantageous that the photosensitive silver halide emulsion is applied in amounts less than 5 g of $AgNO_3/m^2$ more preferably less than 1.5 g/$m^2$ and most preferably less than 0.8 g/$m^2$. The minimum required amount of the photosensitive silver halide emulsion depends on a number of parameters such as the type, composition and size of the photosensitive silver halide grains, type of silver salt contained in the substantially light insensitive layer etc. The minimum amount of photosensitive silver halide emulsion can easily found by routine experimentation i.e. when the amount of photosensitive silver halide becomes too low no image will be obtained.

The size distribution of the silver halide particles of the photosensitive silver halide emulsion layer to be used according to the present invention can be homodisperse or heterodisperse. A homodisperse size distribution is obtained when 95% of the grains have a size that does not deviate more than 30% from the average grain size.

Preferably during the precipitation stage Iridium and/or Rhodium containing compounds or a mixture of both are added. The concentration of these added compounds ranges from $10^{-8}$ to $10^{-3}$ mole per mole of $AgNO_3$, preferably between $10^{-7}$ and $10^{-4}$ mole per mole of $AgNO_3$. This results in the building in the silver halide crystal lattice of minor amounts of Iridium and/or Rhodium, so-called Iridium and/or Rhodium dopants. As known to those skilled in the art numerous scientific and patent publications disclose the addition of Iridium or Rhodium containing compounds or compounds containing other elements of Group VIII of the Periodic System during emulsion preparation.

The photosensitive emulsion can be chemically sensitized e.g. by adding sulphur-containing compounds during the chemical ripening stage e.g. allyl isothiocyanate, allyl thiourea, and sodium thiosulphate. Also reducing agents e.g. the tin compounds described in BE-P 493,464 and 568,687, and polyamines such as diethylene triamine or derivatives of aminomethane-sulphonic acid can be used as chemical sensitizers. Other suitable chemical sensitizers are noble metals and noble metal compounds such as gold, platinum, palladium, iridium, ruthenium and rhodium. This method of chemical sensitization has been described in the article of R. KOSLOWSKY, Z. Wiss. Photogr. Photophys. Photochem. 46, 65-72 (1951).

The photosensitive emulsion(s) of the photographic element of the present invention can be spectrally sensitized according to the spectral emission of the exposure source for which the photographic element is designed.

Suitable sensitizing dyes for the visible spectral region include methine dyes such as those described by F.

M. Hamer in "The Cyanine Dyes and Related Compounds", 1964, John Wiley & Sons. Dyes that can be used for this purpose include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes.

To enhance the sensitivity in the near infra-red region use can be made of so-called supersensitizers in combination with infra-red sensitizing dyes. Suitable supersensitizers are described in Research Disclosure Vol 289, May 1988, item 28952.

The spectral sensitizers can be added to the photosensitive emulsion(s) in the form of an aqueous solution, a solution in an organic solvent or in the form of a dispersion.

The silver halide emulsions may contain the usual stabilizers e.g. homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxy or amino groups. Compounds of this kind have been described by BIRR in Z. Wiss. Photogr. Photophys. Photochem. 47, 2–27 (1952). Other suitable stabilizers are i.a. heterocyclic mercapto compounds e.g. phenylmercaptotetrazole, quaternary benzothiazole derivatives, and benzotriazole. Preferred compounds are mercapto substituted pyrimidine derivatives as disclosed in U.S. Pat. No. 3,692,527.

The silver halide emulsions may contain pH controlling ingredients. Preferably the emulsion layer is coated at a pH value below the isoelectric point of the gelatin to improve the stability characteristics of the coated layer. Other ingredients such as antifogging agents, development accelerators, wetting agents, and hardening agents for gelatin may be present. The silver halide emulsion layer may comprise light-screening dyes that absorb scattering light and thus promote the image sharpness. Suitable light-absorbing dyes are described in i.a. U.S. Pat. No. 4,092,168, U.S. Pat. No. 4,311,787, DE-P 2,453,217, and GB-P 7,907,440.

Development acceleration can be accomplished with the aid of various compounds, preferably polyalkylene derivatives having a molecular weight of at least 400 such as those described in e.g. U.S. Pat. Nos. 3,038,805 - 4,038,075 - 4,292,400.

More details about the composition, preparation and coating of silver halide emulsions can be found in e.g. Product Licensing Index, Vol. 92, December 1971, publication 9232, p. 107–109.

The photographic material of the present invention may contain additional hydrophillic layers in water permeable relationship with the image-receiving layer and the layers containing silver salt particles. For example a hydrophillic layer may be applied as an outermost layer as a protecting or anti-stress layer.

In a preferred embodiment of the present invention an intermediate hydrophillic layer, serving as antihalation layer, is provided between the support and the silver halide emulsion layer. This layer can contain the same light-absorbing dyes as described above for the emulsion layer; as alternative finely divided carbon black can be used for the same antihalation purposes as described in U.S. Pat. No. 2,327,828. On the other hand, in order to gain sensitivity, light reflecting pigments, e.g. titaniumdioxide can be present. Further this layer can contain hardening agents, matting agents, e.g. silica particles, and wetting agents. The antihalation layer can also be provided between both silver salt layers provided that the photosensitive silver halide layer is remotest from the support.

The hydrophillic layers comprised in the photographic material usually contain gelatin as hydrophillic colloid binder. Mixtures of different gelatins with different viscosities can be used to adjust the rheological properties of the layer. Like the silver salt containing layers the other hydrophillic layers are coated preferably at a pH value below the isoelectric point of the gelatin. But instead of or together with gelatin, use can be made of one or more other natural and/or synthetic hydrophillic colloids, e.g. albumin, casein, zein, polyvinyl alcohol, alginic acids or salts thereof, cellulose derivatives such as carboxymethyl cellulose, modified gelatin, e.g. phthaloyl gelatin etc.

The hydrophillic layers of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts of the type, described in U.S. Pat. No. 4,063,952.

The photographic element used according to the present invention may further comprise various kinds of surface-active agents in the photographic emulsion layer or in at least one other hydrophillic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Preferably compounds containing perfluorinated alkyl groups are used. Such surface-active agents can be used for various purposes e.g. as coating aids, as compounds preventing electric charges, as compounds improving slidability, as compounds facilitating dispersive emulsification and as compounds preventing or reducing adhesion.

The photographic element of the present invention may further comprise various other additives such as e.g. compounds improving the dimensional stability of the photographic element, UV-absorbers, spacing agents or matting agents and plasticizers. Preferred spacing agents are $SiO_2$ particles having an average size of from 0.8 μm to 15 μm. These spacing agents may be present in one or more layers comprised on the support of the photographic material.

Suitable additives for improving the dimensional stability of the photographic element are e.g. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth-)acrylates, and styrene sulphonic acids.

Suitable physical development nuclei for use in accordance with the present invention are e.g. colloidal silver, heavy metal sulphides e.g. silver sulphide, nickel sulphide, palladium sulphide, cobalt sulphide, zinc sulphide, silver nickel sulphide etc. The image-receiving layer containing the physical development nuclei may also contain a hydrophillic binder.

The support of the photographic material used in accordance with the present invention can be any of the support materials customarily employed in the art. They include paper coated on one or both sides with an Alpha-olefin polymer, e.g. polyethylene, glass or film, e.g. cellulose acetate film, polyvinyl acetal film, polystyrene film, polyethylene terephthalate film etc. Polyethylene terephthalate film coated with a subbing layer to improve the adhesion of the thereon deposited layers of the invention is preferred. When the photographic material of the present invention is intended for use in COM-applications it is desirable that the support is highly antistatic and should therefore be highly electroconductive.

According to the method of the present invention the photographic material is information-wise exposed and subsequently developed in an alkaline processing solution in the presence of (a) developing agent(s) and (a) silver halide solvent(s).

The photographic material of the present invention is exposed in an apparatus according to its particular application, e.g. a conventional process camera containing a conventional light source or a laser containing device.

Suitable developing agents for developing the exposed silver halide are e.g. hydroquinone-type and 1-phenyl-3-pyrazolidone-type developing agents as well as p-monomethylaminophenol and derivatives thereof. Preferably used is a combination of a hydroquinone-type and 1-phenyl-3-pyrazolidone-type developing agent whereby the latter is preferably incorporated in one of the layers comprised on the support of the photographic material. A preferred class of 1-phenyl-3-pyrazolidone-type developing agents is disclosed in the European patent application number 90200458.9. It was found that most advantage of the present invention is taken when at least one of the there disclosed developing agents are present in the photographic material of the present invention preferably in the layer(s) comprising the photosensitive and/or substantially light insensitive silver salt particles. Other type of developing agents suitable for use in accordance with the present invention are reductones e.g. ascorbic acid derivatives. Such type of developing agents are disclosed in the unpublished European patent application number 91200311.8.

The developing agent or a mixture of developing agents can be present in an alkaline processing solution and/or in the photographic material. In case the developing agent or a mixture of developing agents is contained in the photographic material, the processing solution can be merely an aqueous alkaline solution that initiates and activates the development.

The pH of the alkaline processing solution is preferably between 10 and 13. The desired pH of the processing solution can be reached by incorporating alkaline substances in the processing solution. Suitable alkaline substances are inorganic alkali e.g. sodium hydroxide, potassium carbonate or aminoalkohols or mixtures thereof. Preferably used alkanolamines are tertiary alkanolamines e.g. those described in EP-A-397925, EP-A-397926, EP-A-397927, EP-A-398435 and U.S. Pat. No. 4,632,896. A combination of alkanolamines having both a $pk_a$ above or below 9 or a combination of alkanolamines whereof at least one has a $pk_a$ above 9 and another having a $pk_a$ of 9 or less may also be used as disclosed in the Japanese patent applications laid open to the public numbers 73949/63, 73953/61, 169841/61, 212670/60, 73950/61, 73952/61, 102644/61, 226647/63, 229453/63, U.S. Pat. No. 4,362,811, U.S. Pat. No. 4,568,634 etc. The concentration of these alkanolamines is preferably from 0.1 mol/l to 0.9 mol/l.

Preferably used silver halide solvents are water soluble thiosulphate compounds such as ammonium and sodium thiosulphate, or ammonium and alkali metal thiocyanates. Other useful silver halide solvents (or "complexing agents") are described in the book "The Theory of the Photographic Process" edited by T. H. James. 4th edition, p. 474–475 (1977), in particular sulphites and uracil. Further interesting silver halide complexing agents are cyclic imides, preferably combined with alkanolamines, as described in U.S. Pat. No. 4,297,430 and U.S. Pat. No. 4,355,090. 2-mercaptobenzoic acid derivatives are described as silver halide solvents in U.S. Pat. No. 4,297,429, preferably combined with alkanolamines or with cyclic imides and alkanolamines.

The silver halide solvent(s) may be partly or completely present in the photographic material. When the silver halide solvent is incorporated in the photographic material it may be incorporated as a silver halide solvent precursor as disclosed in e.g. Japanese published unexamined patent applications no. 15247/59 and 271345/63, U.S. Pat. No. 4,693,955 and U.S. Pat. No. 3,685,991.

Developing of the information-wise exposed photographic material is preferably carried using a single processing liquid. However use can be made of two processing liquids whereby only the second liquid that is applied comprises a silver halide solvent. The DTR-development step may also be followed by a fixing step.

The present invention is illustrated with the following examples without limiting it thereto. All parts are by weight unless otherwise specified.

EXAMPLE 1

8 different samples were prepared as follows. To a polyethylene terephthalate film support coated with a hydrophillic adhesion layer were coated in the order given (1) a base layer of gelatin, (2) a substantially light insensitive layer comprising a silver chlorobromide emulsion not chemically nor spectrally sensitized, (3) a photosensitive layer comprising a silver chlorobromide emulsion which was orthochromatically sensitized and chemically sensitized, (4) an intermediate layer of gelatin and (5) a layer of physical development nuclei. To further reduce the speed of the silver halide of the substantially light insensitive layer the silver halide of samples 3 and 4 was doped with $10^{-5}$ mmol per mol of silver halide.

The composition of each of these different layers is shown in table 1. The silver halide emulsions were prepared according to the double-jet method.

TABLE 1

| compound | layer number (1) | (2) | (3) | (4) | (5) |
|---|---|---|---|---|---|
| gelatin (g/m²) | 2.0 | 0.9 | 0.9 | 1.4 | 2.0 |
| Nuclei* (mol/m²) | | | | | $4*10^{-5}$ |
| Hydroquinone (mol/m²) | | | | $1.3*10^{-3}$ | $3.0*10^{-3}$ |
| I (mol/m²) | | | | $2.3*10^{-4}$ | $5.3*10^{-4}$ |
| II (mol/m²) | $1.6*10^{-5}$ | | | | |
| III (mol/m²) | | | $2.0*10^{-6}$ | | |
| IV (mol/m²) | | | $2.1*10^{-5}$ | | |

*amount of nuclei is expressed as amount of sulphide-ion
I = 1-phenyl-4,4-dimethyl-3-pyrazolidone

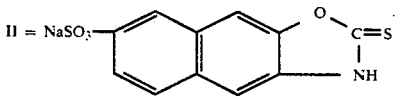

III = 1-phenyl-5-mercaptotetrazole
IV = 1-(3,4-Dichlorophenyl)-tetrazole-5-thiol The 8 samples were different in the amount of bromide contained in the silver chlorobromide emulsion of the two silver halide emulsion layers, the particle size of the silver halide and the type of physical development nuclei. For samples 1 to 7 the type of physical development nuclei were PdS while for sample 8 it were AgNiS physical development nuclei. Samples 1 and 2 are included for comparison and do not contain layer (2). The remaining differences between the different samples is shown in table 2

TABLE 2

| Sample | Layer (2) Br (mol %) | Size (μm) | AgX (g/m²) | Layer (3) Br (mol %) | Size (μm) | AgX (g/m²) |
|---|---|---|---|---|---|---|
| 1 | | | | 1.8 | 0.3 | 1 |
| 2 | | | | 1.8 | 0.3 | 2 |
| 3 | 1.8 | 0.38 | 0.9 | 1.8 | 0.3 | 0.9 |
| 4 | 1.8 | 0.38 | 0.9 | 0.5 | 0.55 | 0.9 |
| 5 | 5.0 | 0.11 | 1.0 | 1.8 | 0.6 | 1.0 |
| 6 | 5.0 | 0.11 | 0.9 | 2.7 | 1.1 | 0.9 |
| 7 | 5.0 | 0.11 | 0.9 | 2.7 | 1.15 | 0.9 |
| 8 | 5.0 | 0.11 | 0.9 | 2.7 | 1.15 | 0.9 |

*the amount of silver halide (AgX) is expressed as the corresponding amount of $AgNO_3$
**the size is expressed as an average diameter.

Each of the samples was image-wise exposed and subsequently developed using an alkaline activating liquid CP 296 (commercially available from Agfa-Gevaert N.V.) containing thiosulphate as a silver halide solvent and fixed using a fixing solution G333 (commercially available from Agfa-Gevaert N.V.) containing thiosulphate.

For each of the samples the minimum and maximum transmission density and the gamma value (maximum gradient of the straight line of the sensitometric curve) were measured. These results are shown in table 3.

TABLE 3

| Sample | $D_{max}$ | $D_{min}$ | Gamma |
|---|---|---|---|
| 1 | 2.00 | 0.81 | 6.5 |
| 2 | 2.80 | 1.60 | 8.0 |
| 3 | 2.60 | 0.80 | 5.6 |

TABLE 3-continued

| Sample | $D_{max}$ | $D_{min}$ | Gamma |
|---|---|---|---|
| 4 | 2.40 | 0.60 | 5.2 |
| 5 | 2.80 | 0.38 | 6.0 |
| 6 | 2.20 | 0.23 | 7.7 |
| 7 | 2.35 | 0.20 | 5.9 |
| 8 | 2.64 | 0.20 | 6.7 |

From table 3 it can be seen that samples 5 to 8 yield an acceptable image quality i.e. the minimum densities are acceptable. Samples 1 and 2 do not contain a substantially light insensitive silver halide layer and do not yield a good differentiation between the image and non-image areas.

EXAMPLE 2

Preparation of the non-light sensitive silver chloride emulsion (a).

| | | |
|---|---|---|
| Solution A (35° C.): | water | 1500 ml |
| | $AgNO_3$ | 498 g |
| Solution B (35° C.): | water | 1290 ml |
| | NaCl | 181 g |
| Solution C (35° C.): | water | 2250 ml |
| | gelatin | 70 g |

Solution C was brought to 45° C. and 65 ml of a solution containing 0.136% $Na_3RhCl_6$ was added. After adjusting the pH to 3.5 solution A and B were added simultaneously to solution C in ten minutes. The resulting emulsion was precipitated by adding polystyrene sulfonic acid. The precipitate was rinsed several times and redispersed by adding 180 g of gelatin to a final content of 200 g of $AgNO_3$ per kg of emulsion. The thus obtained emulsion was physically ripened for 2 hours. A non-light sensitive silver chloride emulsion was thus obtained. The average diameter of the grains was 0.154 μm.

Preparation of the non-light sensitive silver chlorobromide emulsion (b).

| | | |
|---|---|---|
| Solution D (35° C.): | water | 1500 ml |
| | $AgNO_3$ | 498 g |
| Solution E (35° C.): | water | 1360 ml |
| | NaCl | 184 g |
| | KBr | 10.5 g |
| Solution F (35° C.): | water | 2260 ml |
| | gelatin | 70 g |
| | KBr | 3.5 g |

Solution F was brought to 50° C. and 30 ml of a solution containing 0.136% $Na_3RhCl_6$ was added. After adjusting the pH to 3.5 solution D and E were added simultaneously to solution F in ten minutes. The resulting emulsion was precipitated by adding polystyrene sulfonic acid. The precipitate was rinsed several times and redispersed by adding 180 g of gelatin to a final content of 200 g of $AgNO_3$ per kg of emulsion. The thus obtained emulsion was physically ripened for 2 hours. A non-light sensitive silver halide emulsion containing 96 mol % of silver chloride and 4 mol % of silver bromide was thus obtained. The average diameter of the grains was 0.196 μm.

Preparation of a light sensitive silver chloride emulsion.

| | | |
|---|---|---|
| Solution G (25° C.): | water | 1000 ml |

-continued

| | | |
|---|---|---|
| | $AgNO_3$ | 498 g |
| Solution H (25° C.): | water | 1000 ml |
| | NaCl | 185 g |
| Solution U (35° C.): | water | 780 ml |
| | gelatin | 46 g |
| | methionine | 5 g |
| | NaCl | 2.3 g |
| Solution L (25° C.): | water | 2000 ml |
| | $AgNO_3$ | 996 g |
| Solution M (25° C.): | water | 2000 ml |
| | NaCl | 370 g |
| Solution N (35° C.): | water | 400 ml |
| | gelatin | 92 g |

Solution U and N were brought to 60° C. Solution G was then added in 50 minutes and solution H in 48 minutes to solution U. The thus obtained emulsion was physically ripened for 25 minutes at 60° C. Then after adding solution N the emulsion was stirred for 5 minutes. Solution L was then added in 50 minutes and solution M in 48 minutes to the emulsion. Physical ripening was carried out for 15 minutes at 60° C. The resulting emulsion was precipitated by adding polystyrene sulfonic acid. The precipitate was rinsed several times and redispersed by adding 204 g of gelatin to a final content of 170 g of $AgNO_3$ per kg of emulsion. Silver chloride grains with an average diameter of 1.03 μm were obtained. The silver chloride emulsion was subsequently chemically sensitized and then spectrally sensitized with an ortho sensitizer.

12 different samples were prepared as follows. To a polyethylene terephthalate film support coated with a hydrophillic adhesion layer were coated in the order given:

(1) a layer comprising one of the above described substantially light insensitive silver halide emulsion (a) or (b).

(2) a layer comprising the above described photosensitive silver chloride emulsion, (3) a layer of physical development nuclei. The type of physical development nuclei was PdS.

The composition of each of these different layers is shown in table 4.

TABLE 4

| compound | layer number (1) | (2) | (3) |
|---|---|---|---|
| gelatin (g/m²) | 1.92 | 1.31 | 0.25 |
| nuclei (mol/m²)* | / | / | $1.10^{-5}$ |
| III (mol/g $AgNO_3$)** | / | $1.5\ 10^{-6}$ | / |
| II (mol/g $AgNO_3$))** | / | $3.4\ 10^{-6}$ | / |

III = see example 1
II = see example 1
*Amount of nuclei is expressed as amount of sulphide-ion.
**The amount of III and II is expressed in mol per gram $AgNO_3$ corresponding to the light sensitive emulsion.

The 12 samples differ in the amount of silver halide contained in the two silver halide emulsion layers and in the kind of light-insensitive silver halide emulsion as shown in table 5.

TABLE 5

| Sample | Layer (1) emulsion | Layer (1) AgX g/m²* | Layer (2) AgX g/m²* |
|---|---|---|---|
| 1 | a | 1 | 0.4 |
| 2 | a | 1 | 0.3 |
| 3 | a | 1 | 0.2 |
| 4 | a | 1.2 | 0.4 |
| 5 | a | 1.2 | 0.3 |
| 6 | a | 1.2 | 0.2 |

TABLE 5-continued

| Sample | Layer (1) emulsion | Layer (1) AgX g/m²* | Layer (2) AgX g/m²* |
|---|---|---|---|
| 7 | b | 1 | 0.4 |
| 8 | b | 1 | 0.3 |
| 9 | b | 1 | 0.2 |
| 10 | b | 1.2 | 0.4 |
| 11 | b | 1.2 | 0.3 |
| 12 | b | 1.2 | 0.2 |

*The amount of silver halide is expressed as the corresponding amount of $AgNO_3$.

Each of the samples was exposed (EG&G; $10^{-5}$ sec; U460 filter) through a discontinuous widge (widgeconstant=0.15) and subsequently developed using an alkaline developing liquid CP297b (commercially available from Agfa-Gevaert N.V.) containing hydroquinone and 1-phenyl-4-methyl-3-pyrazolidone as developing agents and thiosulphate as a silver halide solvent and fixed using a fixing solution containing thiosulphate.

For each of the samples the minimum and maximum transmission density and the speed were measured. These results are shown in table 6.

TABLE 6

| Sample | $D_{MAX}$ | $D_{MIN}$ | SPEED* |
|---|---|---|---|
| 1 | 1.80 | 0.16 | 11 |
| 2 | 1.81 | 0.15 | 9 |
| 3 | 1.86 | 0.29 | 6 |
| 4 | 2.42 | 0.17 | 10 |
| 5 | 2.32 | 0.15 | 8 |
| 6 | 1.98 | 0.60 | 6 |
| 7 | 2.01 | 0.17 | 10 |
| 8 | 1.97 | 0.16 | 9 |
| 9 | 1.92 | 0.31 | 6 |
| 10 | 2.34 | 0.18 | 10 |
| 11 | 2.32 | 0.17 | 8 |
| 12 | 2.30 | 0.48 | 6 |

*The speed is expressed as the number of widgeconstants where the density equals $D_{MIN}$ + 0.1. The higher the number the higher the speed.

We claim:

1. A photographic material comprising on a support an image-receiving layer containing physical development nuclei, a photosensitive silver halide emulsion layer, a substantially light insensitive layer containing silver salt, and an outermost hydrophilic layer being in water-permeable relationship with the image-receiving layer, said support being a film support or a paper support coated on one or both sides with an alpha olefin polymer characterized in that said photosensitive silver halide emulsion layer contains silver halide particles having an average diameter of at least 0.8 μm in an amount of not more than 1.5 g/m² of silver halide expressed as $AgNO_3$, said photosensitive silver halide emulsion layer being located between said image-receiving layer and said substantially light insensitive layer and said substantially light insensitive layer having a speed of at least a factor 10 less than said photosensitive silver halide emulsion layer.

2. A photographic material according to claim 1 wherein said silver salt contained in said substantially light insensitive layer comprises more than 70 mol % of AgCl.

3. A photographic material according to claim 1 wherein said silver halide contained in said photosensitive silver halide emulsion layer has an average diameter of at least 1 μm.

4. A method for making an image comprising the steps of information-wise exposing a photographic material comprising on a support an image-receiving layer containing physical development nuclei, a photosensitive silver halide emulsion layer, a substantially light insensitive layer containing silver salt, and an outermost hydrophilic layer being in water-permeable relationship with the image-receiving layer, said support being a film support or a paper support coated on one or both sides with an alpha olefin polymer characterized in that said photosensitive silver halide emulsion layer contains silver halide particles having an average diameter of at least 0.8 μm in an amount of not more than 1.5 g/m$^2$ of silver halide expressed as $AgNO_3$, said photosensitive silver halide emulsion layer being located between said image-receiving layer and said substantially light insensitive layer and said substantially light insensitive layer having a speed of at least a factor 10 less than said photosensitive silver halide emulsion layer and developing said information-wise exposed photographic material in the presence of (a) developing agent(s) and (a) silver halide solvent(s).

5. A method according to claim 4 wherein said silver salt contained in said substantially light insensitive layer comprises more than 70 mol % of AgCl.

6. A method according to claim 4 wherein said silver halide contained in said photosensitive silver halide emulsion layer has an average diameter of at least 1 μm.

* * * * *